United States Patent [19]

Huelin

[11] Patent Number: 5,063,711

[45] Date of Patent: Nov. 12, 1991

[54] DOOR FRAME STRUCTURE

[76] Inventor: Kirk J. Huelin, "Woodside", Scragged Oak Lane, Detling, Maidstone, Kent, ME14 4HJ, England

[21] Appl. No.: 382,647

[22] PCT Filed: Apr. 19, 1988

[86] PCT No.: PCT/GB88/00299

§ 371 Date: Aug. 3, 1989

§ 102(e) Date: Aug. 3, 1989

[87] PCT Pub. No.: WO88/08478

PCT Pub. Date: Nov. 3, 1988

[30] Foreign Application Priority Data

| | | | |
|---|---|---|---|
| Apr. 29, 1987 | [GB] | United Kingdom | 8710118 |
| Apr. 1, 1988 | [TW] | Taiwan | 77102119 |
| Apr. 5, 1988 | [CA] | Canada | 563215 |
| Apr. 15, 1988 | [EP] | European Pat. Off. | 88-01159 |

[51] Int. Cl.[5] ..... E06B 1/04

[52] U.S. Cl. ..... 49/504; 52/211

[58] Field of Search ..... 52/210–216, 52/173 DS; 49/488, 504, 498, 497

[56] References Cited

U.S. PATENT DOCUMENTS

| | | | |
|---|---|---|---|
| 1,998,791 | 4/1935 | Schanz | 49/498 |
| 2,113,152 | 4/1938 | Johnston | 49/498 |
| 2,121,826 | 6/1935 | Roberts | 49/498 |
| 4,658,548 | 4/1987 | Gevvitsen | 49/498 |

*Primary Examiner*—Richard E. Chilcot, Jr.
*Assistant Examiner*—Michele A. Van Patten
*Attorney, Agent, or Firm*—Laurence R. Brown

[57] ABSTRACT

A sealable frame structure for a closable opening, such as a doorway, comprises a sub-frame (1) which is adapted to be built into an opening in a wall and a frame shroud (7) adapted to be fixed to the sub-frame. The sub-frame is U-shaped in cross-section and its web is provided with a series of holes (2) by means of which the sub-frame may be secured to the wall by anchor fixings. One limb (3) of the U-shaped frame is provided with a series of holes (4) for the reception of studs (8) welded on the frame shroud (7). A strip (9) of stainless steel or like material is secured to the other limb (5) of the subframe by means of bolts (10) and nuts (11) and the frame shroud (7) is secured to the strip (9) by screws (12) which engage in drilled and tapped holes (13) in a strip (14) of steel. An extruded strip (15) of silicone rubber having a protruding profile (16) is fitted over an edge of the strip (9) and forms a seal with the edge of a door closing the doorway. A door is also provided having a stepped edge portion extending along its upper and side edges for engagement with the sealable frame structure.

5 Claims, 3 Drawing Sheets

DOOR FRAME STRUCTURE

This invention relates to an improved sealable frame structure for closable openings such as a door and surrounding frame structure.

In buildings used to house laboratories or other "clean" work areas in the pharmaceutical, biotechnology and allied fields, it is essential that the area be kept sterile while allowing free access for personnel.

The aim of the present invention is to provide a door frame structure or other closable opening which is easy to install and provides a sterile seal for a door when closing the opening.

Accordingly, the present invention provides a sealable frame structure for a closable opening, in which the frame structure comprises a sub-frame adapted to be built into an opening in a wall and a frame shroud adapted to be fixed to the sub-frame, wherein the sub-frame is substantially U-shaped in cross-section comprising a web and two limbs extending from the web, the web of said U being arranged to be secured to the wall around the edges of said opening, in that wherein the frame shroud is fixed to the sub-frame by means of a strip of stainless steel or like material which is fixed to one limb of said U-shaped sub-frame, the other limb of the sub-frame being provided with a series of holes and the frame shroud being provided with a series of studs engageable in said holes, and wherein said frame shroud is provided with a sealing member to form a gas-tight seal for a closing member.

Preferably, the frame shroud forms a channel with the sub-frame to house electrical cables, electric interlocks and/or indicator lights.

The frame shroud is desirably secured to said strip of stainless steel or like material by a series of screws.

According to a preferred embodiment of the invention, the a profiled strip of resilient material fitted over an edge of said strip of stainless steel or like material.

In a preferred form, the closable opening is a doorway and the closing member is a door.

Conveniently, a silicone rubber seal extends across the threshold of the closable opening to produce a gas tight seal with the closing member.

In a preferred construction the door has toughened plate glass windows.

An embodiment of a sealable frame structure in the form of a door frame structure according to the invention will now be described in detail, by way of example, with reference to the drawings in which.

Figure 3:
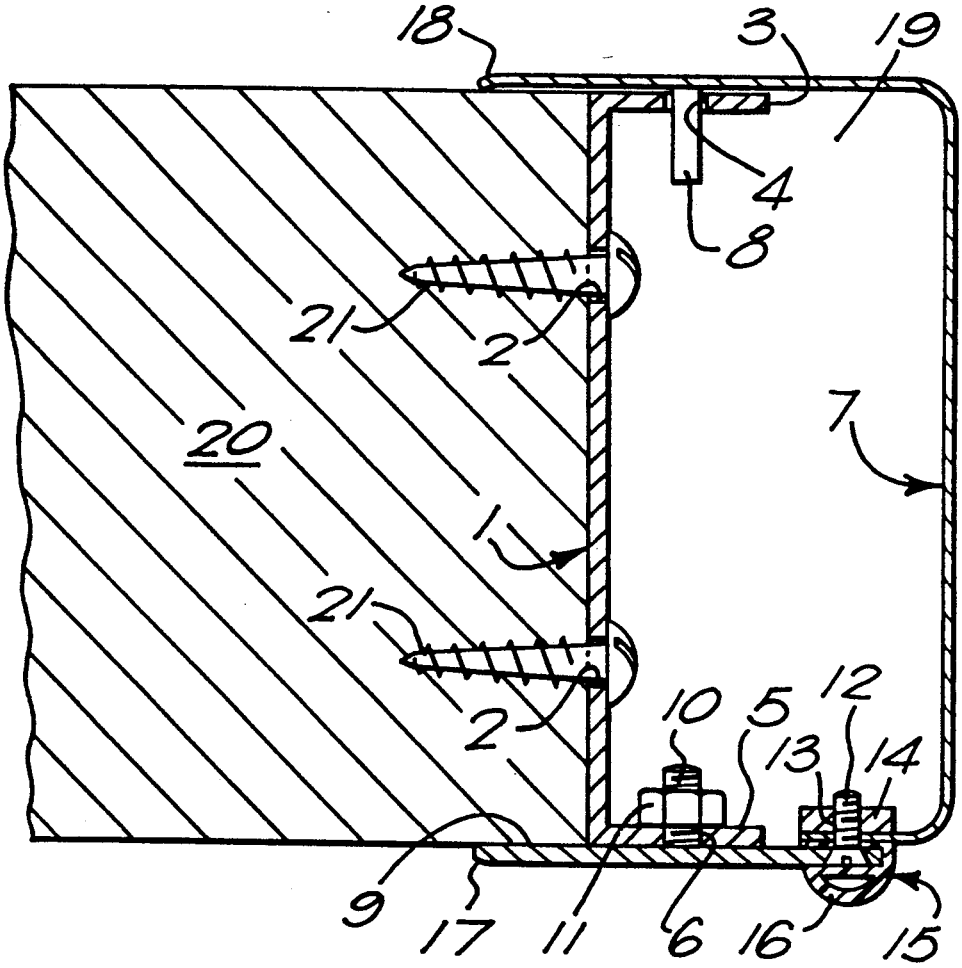
FIG. 3 is a cross-section taken along the line III—III of FIG. 2 and fitted with a shroud and seal for the door frame structure.
Figure 2:
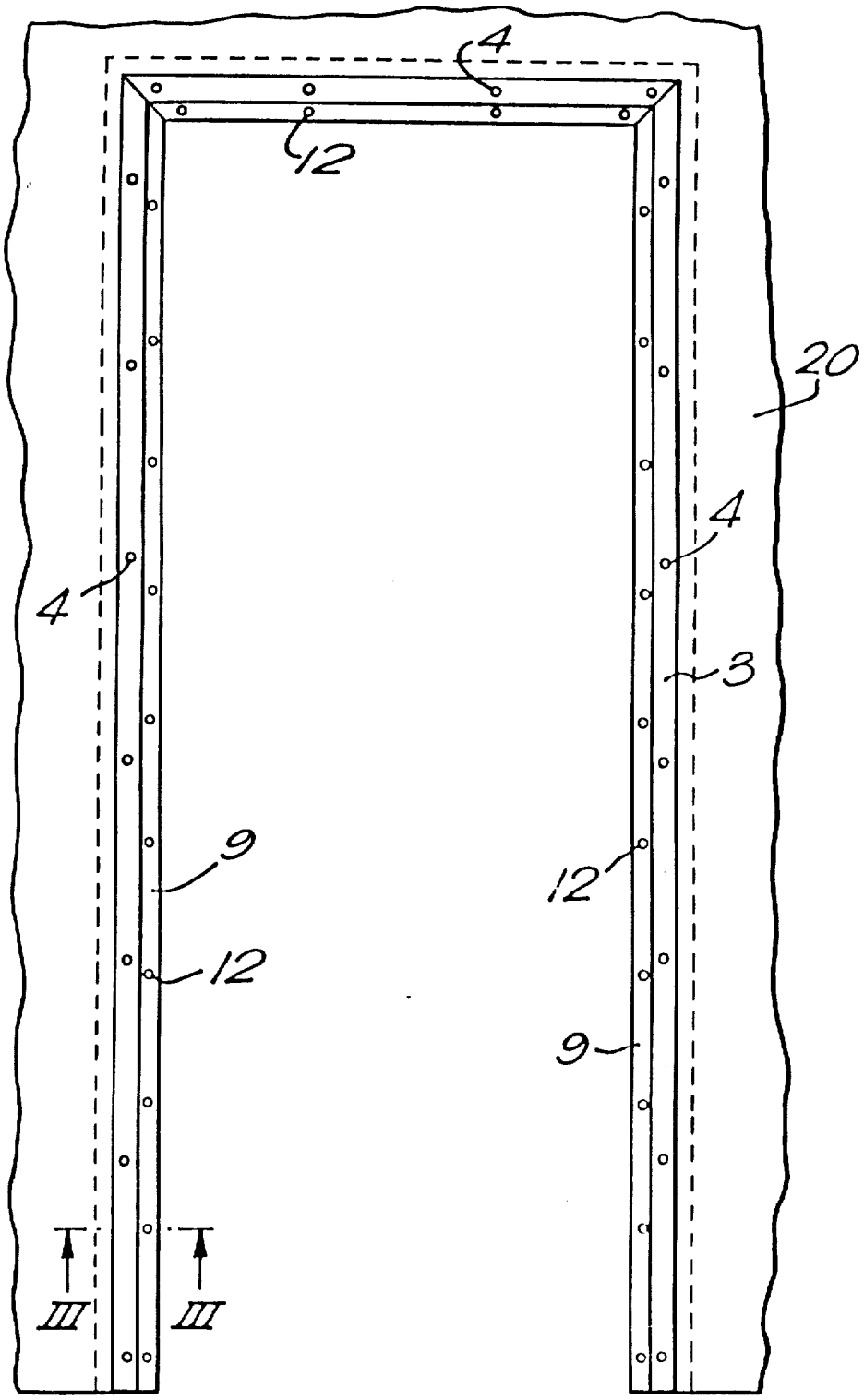

Referring to the drawings, a sub-frame 1 of a door frame structure is built into a wall 20 during construction of the wall forming a plastering stop to ensure accurate plastering and finishing around the frame. The sub-frame is made of mild steel channel section and is secured to the wall through holes 2 by anchor fixings such as screws 21 (FIG. 3). Located down one of the sub-frame channel walls 3 are a series of holes 4 spaced at 300 mm intervals, while the other channel wall 5 has a further series of holes 6 spaced at 600 mm intervals.

The upper mitred corners of the sub-frame are welded internally to form a rigid right angled structure.

Once the sub-frame 1 has been installed in a wall opening in the wall 20, a strip 9 of stainless steel having a series of threaded studs 10 welded to it is secured to the sub-frame, the spacing of the studs 10 being such that each is aligned with a respective hole 6 whereby the studs project through the holes 6 and the strip 9 is secured in place by means of nuts 11 as shown in FIG. 3.

A frame shroud 7 made of shaped 2 mm thick stainless steel can then be fitted over the sub-frame 1. Welded to the shroud 7 are a number of studs 8 which on assembly of the two part frame structure are located in the holes 4. The free end of the strip 9 is secured to the free end of the shroud 7 by countersunk set screws 12, which pass through holes in the shroud and are screwed into drilled and tapped holes 13 in a flat strip 14 of mild steel which is secured, such as by welding, to the shroud 7. The heads of the set screws 12 are covered by an extruded strip of silicone rubber 15 which has a protruding profile 16 to form a seal with the edge of a door closing the doorway. The edge of the strip 9 has a bevel 17 extending around the three sides of the frame structure. Similarly, one edge of the shroud 7 is turned in at 18 to provide a smooth finish with the wall of the building.

When assembled the two part frame structure forms a channel 19 for electrical wiring, electrical interlocks and/or indicator lights.

To assemble the frame structure, the sub-frame 1 is anchored to a wall 20 in an opening in said wall by means of screws 21 or other suitable fastening members which pass through the holes 2 in the base of the U-sectioned sub-frame 1. The stainless steel strip 9 carrying the threaded studs 10 is positioned against the wall 5 of the sub-frame locating the studs in the holes 6 in the sub-frame to which the strip is secured by nuts 11 threaded on the studs 10.

Various modifications can be made to the invention, for example, a silicone rubber seal can be extended across the threshold of the door opening to produce a gas tight seal with the door forming a gas seal enabling the clean area closed by the door to be gas sterilised.

Although the invention has been described with reference to a door and door frame structure, it will be apparent that the opening formed by the sealable frame structure may be a window frame closed by a window or a similar closable opening which provides access to the clean, i.e. sterile area.

I claim:

1. A sealable frame structure for a closable opening, said frame structure comprising a sub-frame which is substantially U-shaped in cross -section consisting of a web and two limbs extending respectively from the sides of the web essentially perpendicular thereto, the web being adapted to be secured to a wall around the edges of said opening with the limbs extending into the opening away from the wall; a strip of material secured to one limb and extending in one direction beyond the web to overlie part of the wall to which the web is secured and extending in the other direction beyond the outer edge of the limb to which it is secured; a frame shroud fixed to the other limb of the sub-frame and to the strip, said shroud extending beyond the said other limb to overlie part of the wall to which the web is secured and being provided with a series of studs and the said other limb of the sub-frame being provided with a series of holes in which the studs are engageable; and a sealing member comprising a profiled strip of resilient material which is fitted over an edge of said first-mentioned strip of material and part of which is held between said strip and the frame shroud to form a gas-tight seal with a closing member.

2. A sealable frame structure according to claim 1, wherein the frame shroud forms a channel with the sub-frame to define a housing for electrical cables, electric interlocks, and indicator locks.

3. A sealable frame structure according to claim 1, wherein the frame shroud is secured to said strip of material by a series of screws.

4. A sealable frame structure according to claim 1, wherein the closable opening is a doorway and the closing member is a door.

5. A sealable frame structure according to claim 4, wherein a silicone rubber seal extends across the threshold of the closable opening to produce a gas tight seal with the closing member.

* * * * *

UNITED STATES PATENT AND TRADEMARK OFFICE

CERTIFICATE OF CORRECTION

PATENT NO. : 5,063,711

DATED : November 12, 1991

INVENTOR(S) : Kirt J. Huelin

Figure 1:
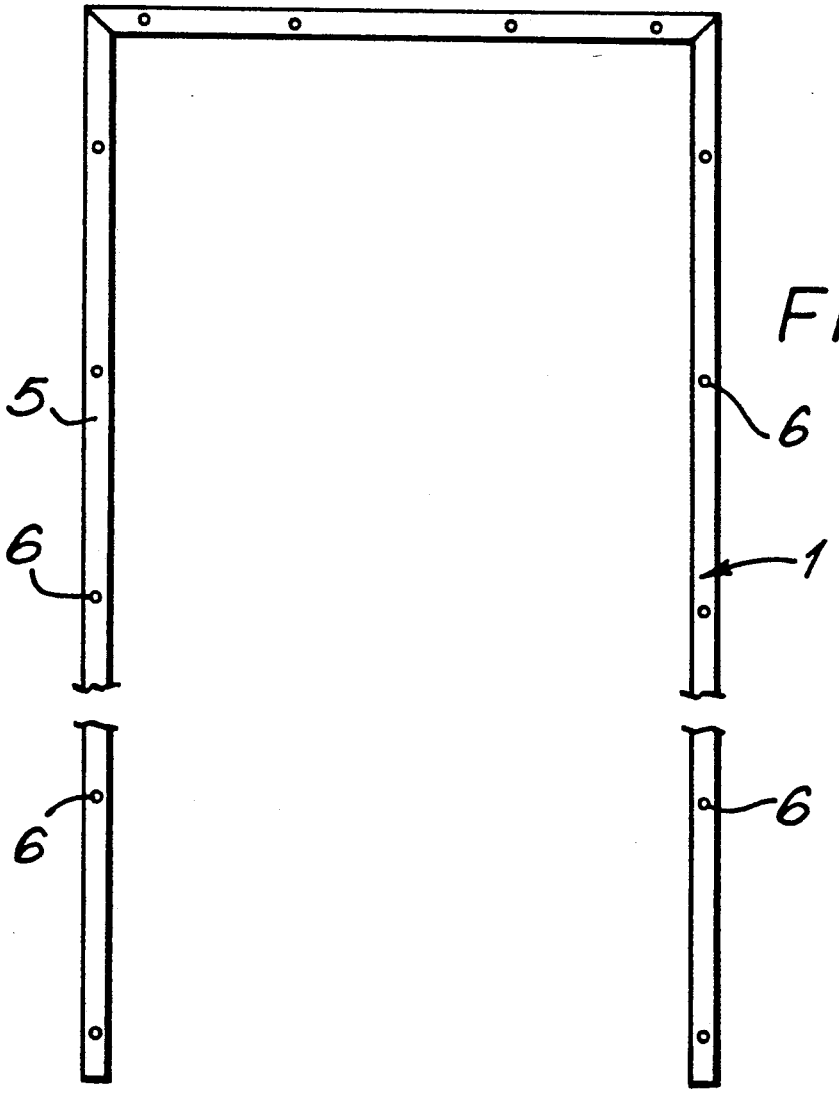
FIG. 1 is an elevation of one side of a sub-frame forming part of the door frame structure.
Figure 2:
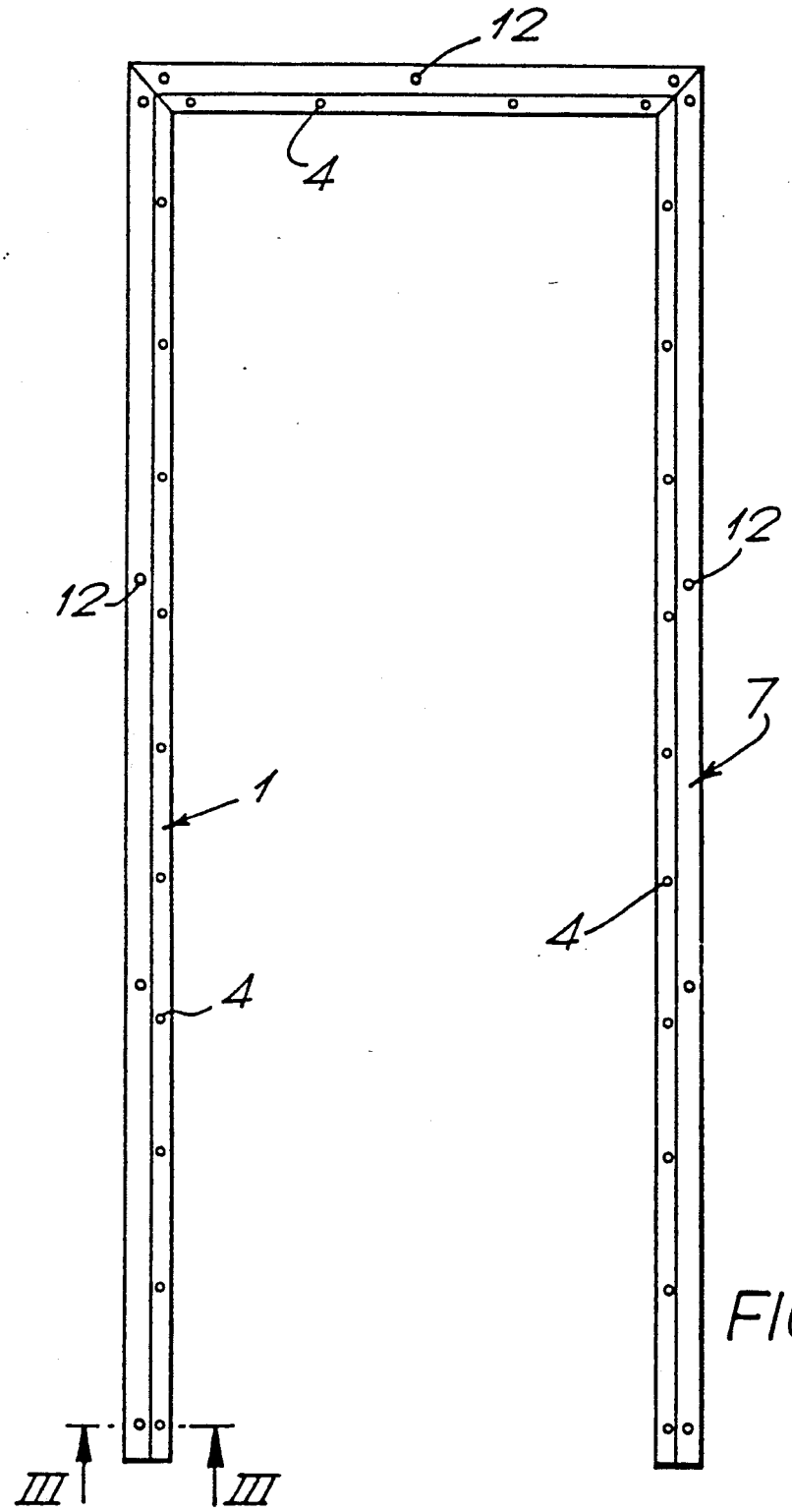
FIG. 2 is an elevation of the other side of the partially-assembled door frame structure to which a seal is to be fitted.

It is certified that error appears in the above-identified patent and that said Letters Patent is hereby corrected as shown below:

The drawing sheet, consisting of FIG. 2, should be deleted and substitute therefor drawing sheet, as shown on the attached page.

Column 1, line 23, delete "in that".

Restore the missing text in Column 2, between lines 39 and 40.

UNITED STATES PATENT AND TRADEMARK OFFICE

CERTIFICATE OF CORRECTION

PATENT NO. : 5,063,711

DATED : November 12, 1991

INVENTOR(S) : Kirt J. Huelin

It is certified that error appears in the above-identified patent and that said Letters Patent is hereby corrected as shown below:

SUBSTITUTE MISSING TEXT:

The shroud 7 is located with its studs 8 in the holes 4 in the sub-frame, the free edge of the shroud being secured to the strip 9 by the countersunk set screws 12 with the interposition of the profiled silicone rubber strip 15 covering the set screws. The frame shroud is fitted after all building construction is completed, thereby avoiding damage to the stainless steel finish of the shroud.

The frame can be readily installed in new or exisiting structures and is equally suitable for both wet and dry constructions. The frame can be fitted with either a standard toughened plate glass or a standard stainless steel door without modification.

UNITED STATES PATENT AND TRADEMARK OFFICE

CERTIFICATE OF CORRECTION

PATENT NO. : 5,063,711

DATED : November 12, 1991

INVENTOR(S) : Kirt J. Huelin

It is certified that error appears in the above-identified patent and that said Letters Patent is hereby corrected as shown below:

Should the shroud be damaged during use it can be replaced without removing either the door or the sub-frame.

The sealable frame structure creates a pressure joint with the surrouding wall finish to prevent the ingress of contamination to the sterile area.

The frame has simple clean lines to provide easy cleaning and sterilization for pharaceutical and biotechnological applications as well as to provide a surface which prevents bacterial or fungal growth.

Signed and Sealed this

Ninth Day of March, 1993

*Attest:*

STEPHEN G. KUNIN

*Attesting Officer*

*Acting Commissioner of Patents and Trademarks*